United States Patent [19]

Quick

[11] 3,990,486

[45] Nov. 9, 1976

[54] QUICK TWIST

[76] Inventor: Robert A. Quick, 7395 W. 14th Ave., Hialeah, Fla. 33014

[22] Filed: Nov. 24, 1975

[21] Appl. No.: 634,434

[52] U.S. Cl. ..... 140/118; 140/149

[51] Int. Cl.[2] ..... B21F 7/00

[58] Field of Search ..... 140/118, 119, 120, 122, 140/149

[56] References Cited

UNITED STATES PATENTS 2,657,718 11/1953 Greathouse ..... 140/120 X 3,701,367 10/1972 Ackerman ..... 140/119

*Primary Examiner*—Travis S. McGehee

[57] ABSTRACT

This device consists primarily of a solid cylinder or ram which will receive wire within grooves. The cylinder or ram is removably received within a collar or sleeve, after which the extending loop is held and the assembly is rotated a multiple number of times, which will produce a neatly twisted length of wire.

1 Claim, 6 Drawing Figures

QUICK TWIST

This invention relates to mechanical jigs, and more particularly to a wire twisting device.

It is therefore the principal object of this invention to provide a wire twisting device which will uniformly twist a wire in a minimum amount of time.

Another object of this invention is to provide a wire twisting device which will consist of a grooved cylinder or ram which will receive a length of wire that is to be uniformly twisted, and the cylinder or ram will be inserted into a cylindrical collar or sleeve, the assembly being rotated to produce a uniformly twisted wire.

A further object of this invention is to provide a device of the type described which will produce twisted wire that may be used for many purposes.

Other objects of the invention are to provide a wire twisting device which is simple in design, inexpensive to manufacture, rugged in construction, easy to use and efficient in operation.

These and other objects will be readily evident upon a study of the following specification and the accompanying drawing, wherein.

Figure 1:
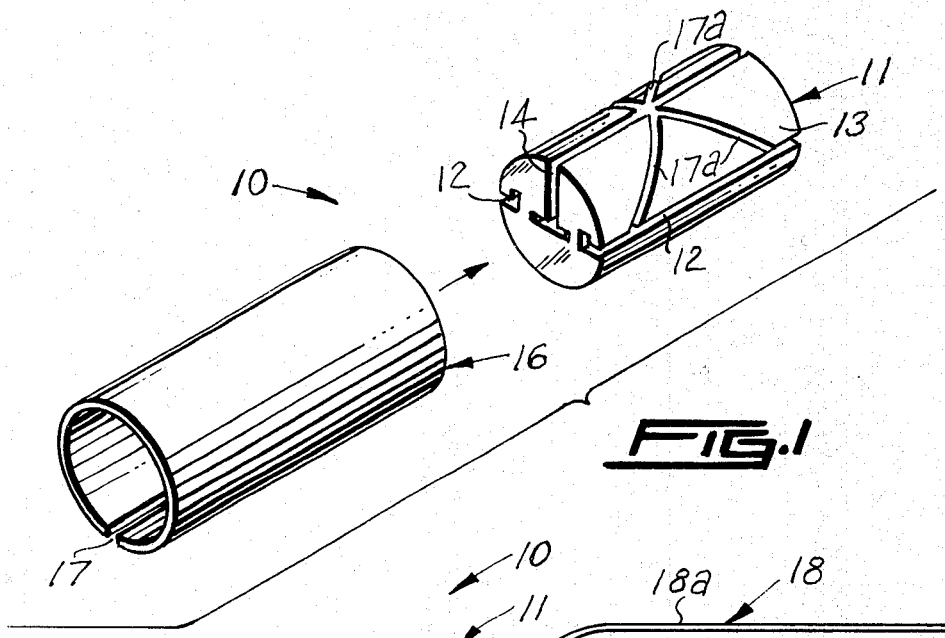
FIG. 1 is an exploded perspective view of the present invention.

According to this invention, a wire twisting device 10 is plastic to include a solid cylinder or ram 11 which may be made of metal, plasttic or other suitable material. A pair of oppositely opposed and longitudinally extending grooves 12, extend partially through the outer periphery 13 of ram 11. A groove 14 is disposed centrally between grooves 12 and also extends the entire length of ram 11. Ram 11 is removably received within collar or sleeve 16 which is provided with a longitudinally extending slot 17 which will enable the user to easily remove long lengths of wire.

It shall be noted that the crossed grooves 17*a*, intersect the grooves 12 and 14.

Figure 2:
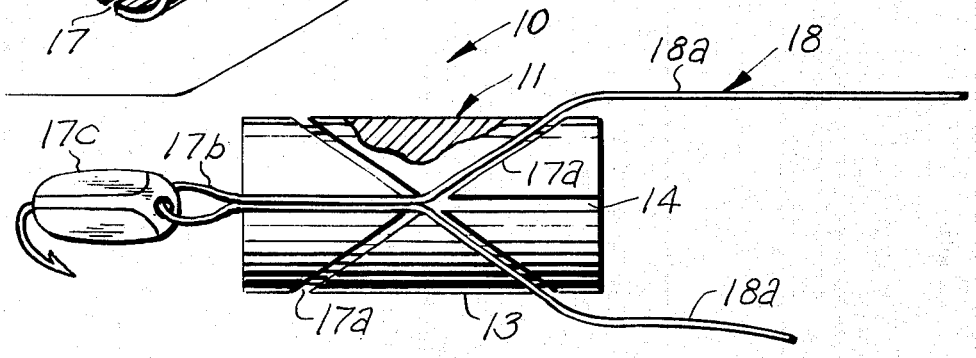
FIG. 2 is an enlarged top plan view of the ram or cylinder member of the invention, showing wire placed into the slots, preparatory to being twisted.

Referring now to FIG. 2 of the drawing, it will be seen that the loop 17*b* which may receive a lure 17*c* or other object, extends from one end of ram 11. The loop 17*b* is formed in wire 18 and must extend from one end of ram 11 for a purpose which hereinafter will be described. As will be seen, the ends 18*a* of wire 18 are placed into the crossed grooves 17*a* so as to separate the paralleling ends 18*a*, prior to slipping the collar 16 over the ram 11. The portion of wire 18 adjacent to the loop 17*b* is received within the groove 14 as shown.

Figure 3:
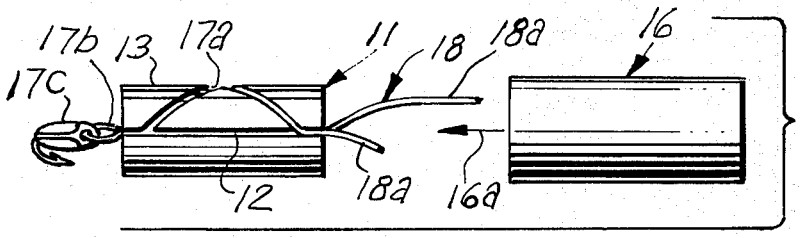
FIG. 3 is an exploded side view of the ram and the collar, shown in elevation with the wire placed in a horizontal side slot.
Figure 4:
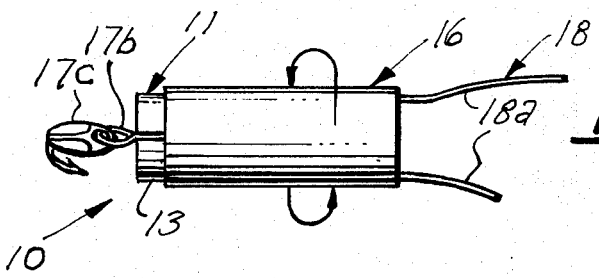
FIG. 4 is a plan view of the assembly shown ready to be rotated to twist the wire.
Figure 5:
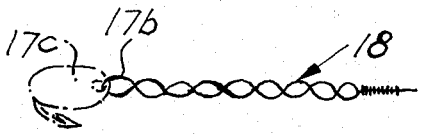
FIG. 5 is a plan view of the wire shown twisted and removed from the assembly.
Figure 6:
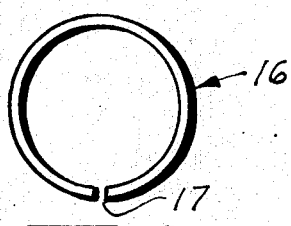
FIG. 6 is an enlarged end view of the collar or sleeve of the device shown in elevation.

Referring now to FIG. 3 of the drawing, it will be seen how the ends 18*a* are received within the longitudinal side grooves 12, prior to ram 11 being received within collar 16 in the direction indicated by the arrow 16*a*.

The device is operated as follows: The wire 18 is first inserted through an opening of a fishing lure or other object 17*c*. The wire two ends are then brought together, so as to form a loop 17*b*, containing the object 17*c*. The portions of the wire ends 18*a*, that are adjacent the loop 17*b*, are than inserted into the center groove 14, and extend from one end of the ram to the point where the diagonally crossing grooves 17*a* intercept the center groove 14, the wire ends 18*a*, at this point, entering the portions of the crossing grooves which are at the end of the ram that is opposite the end from which the loop 17*b* protrudes. The sleeve is then slid on the ram. The assembled ram and sleeve are then rotated approximately 10 $\phi$ times, while the fishing lure, or object 17*c*, is held stationary. Thereafter, the sleeve is then slid off, and the twisted wire is slipped out of the ram grooves as a finished article.

What I now claim is:

1. A wire twisting device, comprising in combination, a grooved cylinder receiving wire to form uniformly twisted turns, a cylindrical sleeve removably receiving the grooved cylinder, rotation of the sleeve and cylinder combination providing the means of twisting the wire received therein, said cylinder including a pair of oppositely opposed and longitudinally extending grooves through its outer periphery, said grooves receiving legs formed in said wire behind a loop portion formed therein, said loop portion receiving an article and extending from one end of said grooved cylinder, the portion of said wire extending from said loop being received in a longitudinal groove disposed centrally between said oppositely opposed grooves of said cylinder, a pair of crossed grooves of said cylinder intersecting said centrally disposed groove and receiving the extending leg ends of said wire, said loop being rendered stationary, manually, and said cylinder and sleeve combination being rotated manually and simultaneously to twist said wire behind said loop end.

* * * * *